United States Patent [19]

White

[11] 4,280,388

[45] Jul. 28, 1981

[54] APPARATUS AND METHOD FOR GENERATING CHORUS AND CELESTE TONES

[76] Inventor: J. Paul White, 1985 Foster Rd., Hatfield, Pa. 19440

[21] Appl. No.: 43,111

[22] Filed: May 29, 1979

[51] Int. Cl.[3] ..... G10H 1/02

[52] U.S. Cl. ..... 84/1.24; 84/DIG. 4

[58] Field of Search ..... 84/1.24, 1.25, DIG. 4

[56] References Cited

U.S. PATENT DOCUMENTS

| | | | |
|---|---|---|---|
| 3,007,361 | 11/1961 | Wayne | 84/DIG. 4 |
| 4,038,898 | 8/1977 | Kniepkamp et al. | 84/1.24 |
| 4,043,243 | 8/1977 | Peterson | 84/DIG. 4 |
| 4,078,466 | 3/1978 | Suenaga et al. | 84/DIG. 4 |
| 4,080,861 | 3/1978 | Wholahan | 84/DIG. 4 |
| 4,160,402 | 7/1979 | Schwartz | 84/1.24 |

*Primary Examiner*—J. V. Truhe

*Assistant Examiner*—Forester W. Isen

[57] ABSTRACT

The operation of the chorus generator of FIG. 3 may be summarized as follows. The generation of a realistic chorus tone depends upon the simultaneous amplitude and phase modulation of a tone signal which initially has little or no choral characteristics. When a tone signal generator is so modulated, the derived audio tone from a loudspeaker will exhibit choral characteristics. A random low frequency signal generator serves as an input to both the amplitude and phase modulation channels. The amplitude modulation signal is merely a suitably delayed replica of the low frequency signal. The phase modulation signal is derived from the low frequency signal by first modifying its amplitude excursions by means of a function generator and then filtering the derived signal by means of a suitable non-minimum phase shift filter.

9 Claims, 6 Drawing Figures

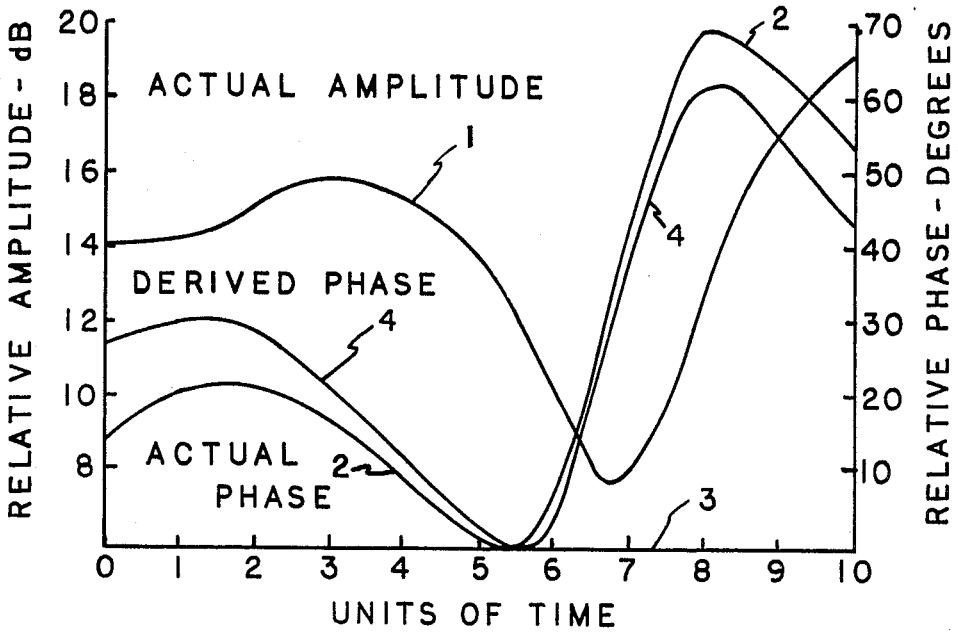
FIG. 1-AMPLITUDE AND PHASE OF TYPICAL CHORUS SIGNAL
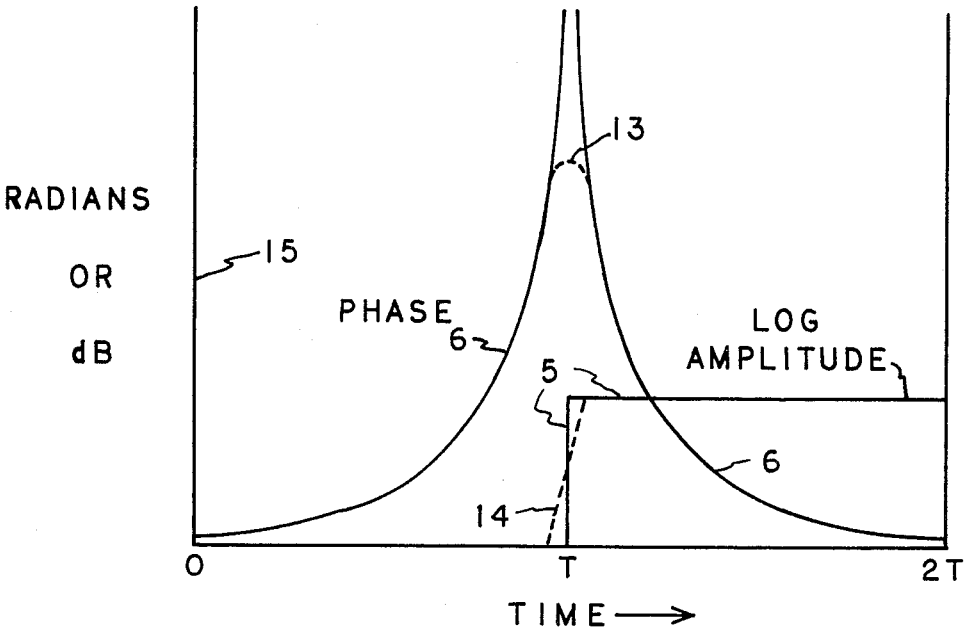
FIG. 2-PHASE & AMPLITUDE vs. TIME

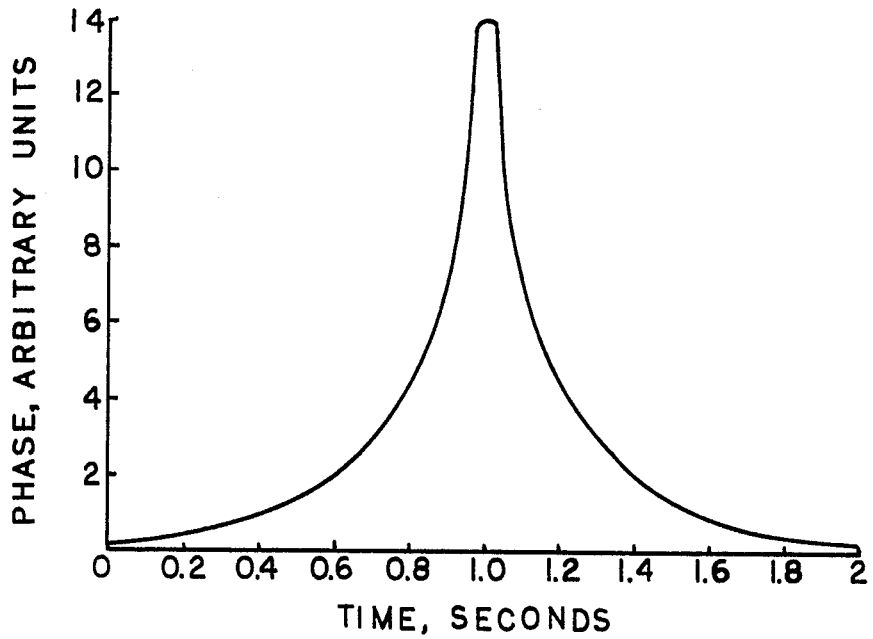
FIG. 4 - PHASE OF 0.1 SEC. RAMP (a=1.2)
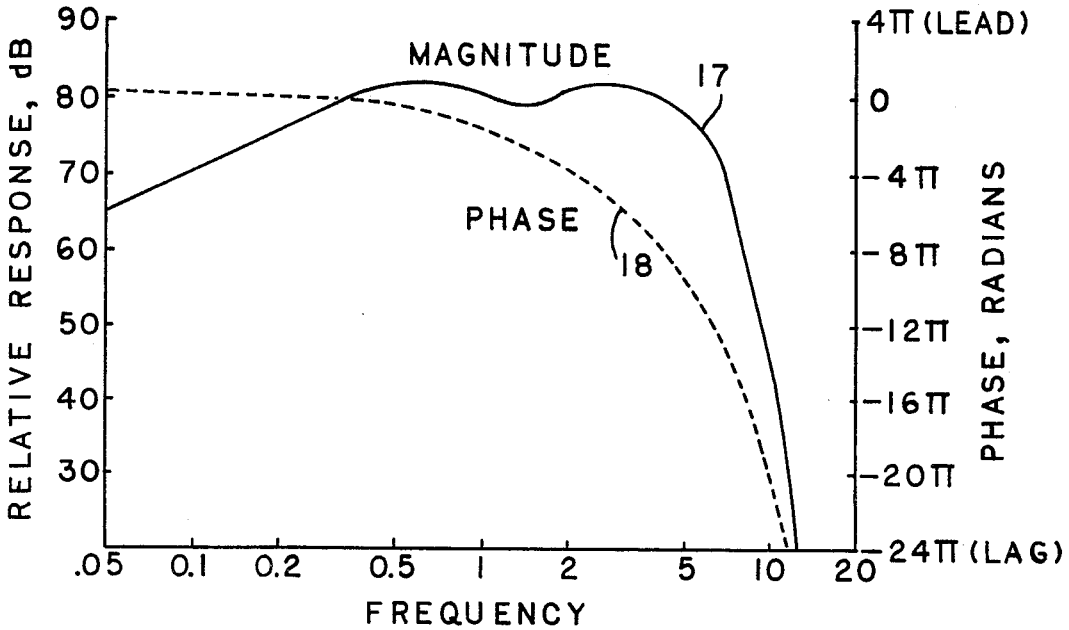
FIG. 5 - TRANSFER FUNCTION OF FILTER

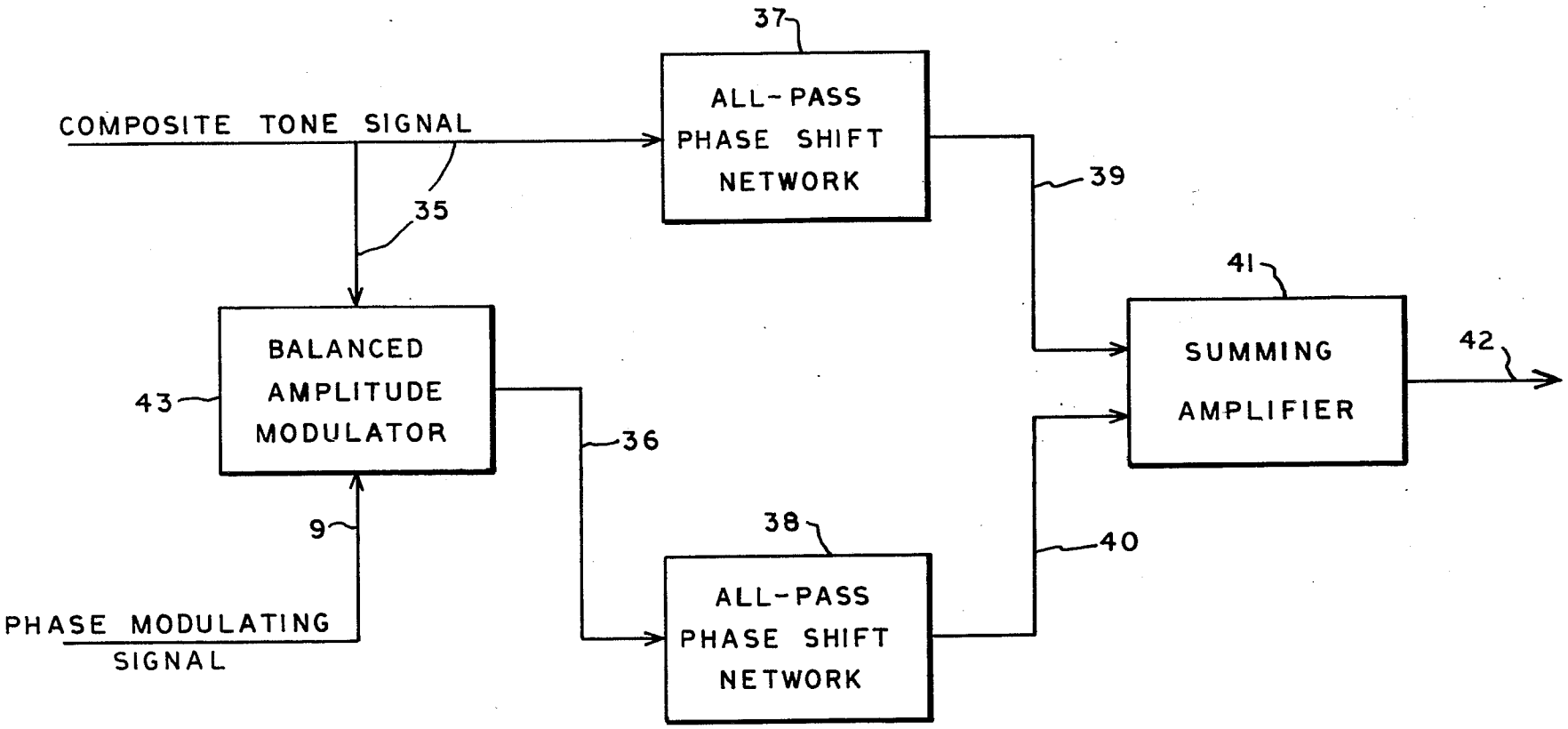
FIG. 6—PHASE MODULATION OF COMPOSITE TONE SIGNALS

APPARATUS AND METHOD FOR GENERATING CHORUS AND CELESTE TONES

BACKGROUND OF THE INVENTION

This invention relates to a method and apparatus for generating a musical signal having the characteristics of the tone produced when a multiplicity of instruments are simultaneously sounding the same note. It is a matter of common experience that, for instance, the violin section of a large orchestra produces a fuller and more pleasing tone than a single violin. Such a musical tone is known as a chorus tone. It derives its appeal from the fact that the various instruments contributing to the composite tone do not maintain the same frequency exactly, so that there is a reinforcing and cancelling of the audible sound which is very desirable. To determine the nature of such a tone, a chorus tone was synthesized by combining signals from a multiplicity of sources which were nearly, but not quite, of the same frequency. The resultant tone signal was then analyzed to determine its composite characteristics. It was found to have a waveform of varying amplitude and phase. It was further observed that these variations when plotted against time had similar characteristics to those of certain electrical networks when the attenuation and phase of such networks is plotted against frequency. Since such networks have a known relationship between their attenuation and phase with respect to frequency, this fact was applied to the relationship between the amplitude and phase of the resultant tone signal using time instead of frequency as the independent variable. It is the object of this invention to provide a method and means for utilizing this relationship to generate a chorus tone from a single non-choral tone when suitably modulated.

BRIEF SUMMARY OF THE INVENTION

A method and means is provided for generating a chorus tone in an electronic musical instrument. A delay means is used to delay the output of a low frequency signal source and thereby produce a first modulating signal. The output of the low frequency signal source is also fed through a tandem means which includes a junction generator feeding a non-minimum phase shift filter to produce a second modulating signal. The tone produced by a tone signal generator is modulated in both amplitude and phase by the first and second modulating signals. The resulting modulated tone signal is rendered audible by a speaker system.

BRIEF DESCRIPTION OF THE DRAWINGS

In the drawings:

FIG. 1 is a graphical representation of a portion of the amplitude and phase of a typical chorus tone signal, and of the phase curve derived from the amplitude curve as described herein.

FIG. 2 is a diagram of the apparent relationship with respect to time of a ramp of the log of amplitude and the corresponding phase.

FIG. 4 is a graphical representation of the response of a filter to a short ramp input. This filter could be used to generate one of the required modulating signals.

FIG. 5 is a diagram of the transfer function of the illustrative filter.

FIG. 6 is a block diagram of apparatus to phase modulate a composite tone signal.

DESCRIPTION OF THE PREFERRED CHORUS TONE GENERATOR

Figure 3:
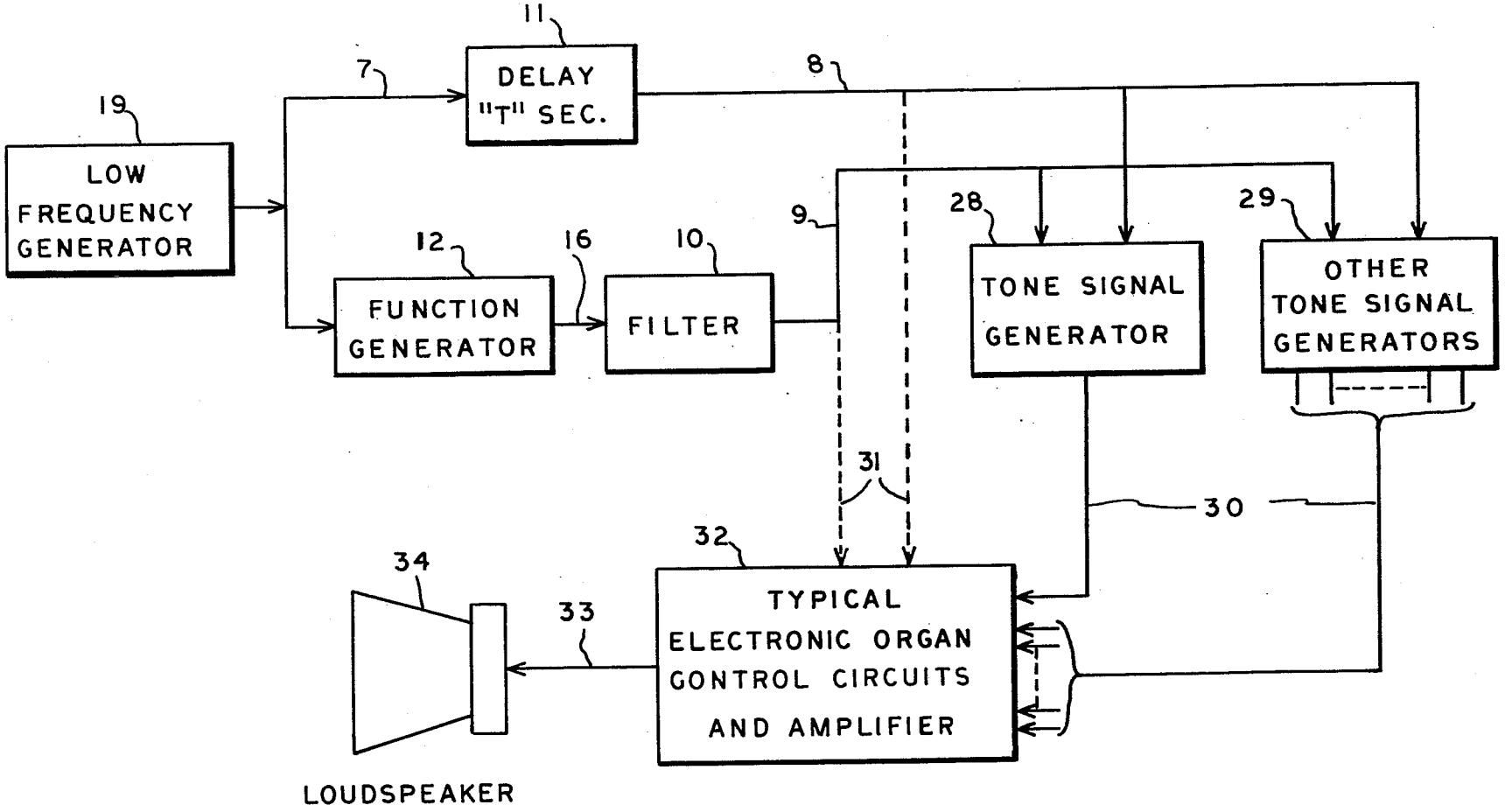
FIG. 3 is a block diagram of a chorus tone generator apparatus, including means to generate the modulating signals required to produce chorus tone signals.

FIG. 1 is a diagram showing the actual composite relative amplitude 1 (plotted in decibels) and phase 2 of a typical chorus tone signal produced by a multiplicity of closely spaced random frequencies. Both of the actual curves of FIG. 1 appear to have characteristics similar to band limited random noise signals having a bandwidth extending up to a frequency equal to the maximum frequency difference between any two of the random frequency signals which were combined. Since these actual curves were generated by the vector summation of these random frequencies over a period of time, it seems inconceivable that they could be completely unrelated as U.S. Pat. No. 3,004,459 teaches by inference. Inspection of FIG. 1 reveals that the relationship between the amplitude curve 1 and the phase curve 2 is similar to the relationship between the amplitude and phase shift characteristics of minimum phase shift networks. The only difference is that these latter curves are plotted against the logarithm of frequency, whereas those of FIG. 1 are plotted against time. Typical curves describing minimum phase shift networks are shown, for example, in H. W. Bode, "Network Analysis and Feedback Amplifier Design", first edition, Chaps. 14 and 15, and in particular FIG. 14.8 on page 316, and charts V through IX, pp 350–354. To compare the curves of FIG. 1 with the minimum phase shift network theory requires that each unit of time along the abscissa 3 be related to a frequency ratio, and to make the comparison a value of 1.95 was chosen for this ratio, so that the entire abscissa 3 is taken as equivalent to a frequency ratio of approximately 800.

To test these assumptions, the log amplitude curve 1 was approximated by seven straight-line segments. The phase shift produced by each of these segments was determined from the minimum phase shift network theory and then added algebracially to produce a total phase shift curve derived from the amplitude curve. This curve 4 is plotted in FIG. 1 along with the actual phase curve 2. The similarity of the derived curve 4 and the actual curve 2 is quite pronounced. The discrepancies at either end of the curve could be due to the fact that amplitude changes beyond the bounds of the figure were not considered. Since such changes would contribute to the phase curve within the figure, their absence contributes an error in the derived curve 4. However, the similarity between the curves is sufficient to justify the conclusion that (1) there is a relationship between the amplitude and phase of a chorus signal, and (2) the relationship is one which may be approximated by the relationship between the amplitude and phase of a minimum phase shift network if the log frequency scale is considered to be a linear time scale. Since the frequency ratio used to represent one unit of time (1.95) in FIG. 1 gave such good results, it is believed that this ratio is not critical.

This invention uses the concept of FIG. 1 as the basis of a method for generating a synthetic chorus tone signal, hereinafter called simply chorus signal. If a band limited noise signal is allowed to amplitude modulate a tone signal, and if the noise signal is processed and thereby so modified that it will phase modulate the same tone signal in such a manner that the relationship between the amplitude and phase of the doubly modulated signal will be similar to the relationship between the amplitude and phase of a true chorus signal as described in FIG. 1, then a chorus signal will have been synthesized from a tone signal which initially had no chorus effect.

Minimum phase shift network theory reveals the fact that an attenuation discontinuity at one frequency produces phase changes at both higher and lower frequencies. It has been shown that the phase of a chorus signal appears to follow a law similar to that of minimum phase shift networks provided that the log frequency scale is replaced by a suitable time scale. If this is done, as shown in FIG. 2, it may be observed that a step change in attenuation (log amplitude 5) vs. time gives rise to a phase shift 6 both preceeding in time and following in time the log amplitude step 5. However, if the log amplitude step 5 is to produce phase change before it occurs, then the circuits generating the phase function must have some previous knowledge of the amplitude step which is about to occur. A block diagram illustrating how this may be accomplished is shown in FIG. 3. A band limited random noise signal 7 provides the input to the circuits generating the signals 8 and 9 required to modulate the tone signal to be enhanced with chorus effect, and is ideally biased so as not to go through zero volts. A suitable filter 10 in FIG. 3 may be defined as one that will yield an output 9 approximating the phase curve 6 of FIG. 2 when subjected to a step change 5 in input T seconds before producing its peak value of output 9. If the delayed signal 8 is used to amplitude modulate a tone signal and the signal 9 is used to phase modulate the same tone signal, then a close approximation to true chorus effect will be produced in the doubly modulated tone signal. Due to the similarity between phase modulation and frequency modulation, the latter may be substituted for the former provided the frequency deviation is made proportional to the rate of change of the desired phase modulation as defined herein. Such a transformation is well known to those skilled in the art, and is within the scope of this invention.

The phase curve 6 of FIG. 2 theoretically goes to infinity when the step in log amplitude occurs. However, since a band limited noise signal cannot contain so abrupt a step, a more practical filter would be one that would produce the phase curve corresponding to a finite ramp change in attenuation. With such a ramp, minimum phase shift network theory indicates that the extreme upper portion of the solid phase curve 6 of FIG. 2 is replaced with the dotted curve 13 having a maximum value at the center of the log amplitude ramp 14 (also dotted). Ideally, the filter 10 of FIG. 3 should function properly at the highest frequency contained in the band limited noise signal 7. In FIG. 3 the function generator 12 converts the amplitude of the input noise signal 7 into equivalent attenuation units in order to correspond with minimum phase shift network theory. If the function generator 12 of FIG. 3 produced a linear function of its input, the final doubly modulated tone signal would be a less accurate representation of a true chorus signal, but would still retain a useful amount of chorus effect, hence, such a configuration is within the scope of this invention.

This method of producing chorus effect might be described further as follows, where all values are for illustration only, and are not to be construed as limitations. Three values must be specified in order to design the delay and filter circuits of FIG. 3. They are as follows: (1) the highest modulating frequency, $f_{max}$; (2) the lowest modulating frequency, $f_{min}$; (3) the frequency ratio "R" corresponding to one second of the time scale of FIG. 4. An illustrative description of a possible selection of these three values, and of the results obtainable therewith is as follows:

(1) $f_{max}$ and the corresponding shortest rise time of the log amplitude ramp 14 and 16 of FIGS. 2 and 3 respectively: If a bandwidth extending up to 5 hertz were desired in the outputs of the delay circuit 11 and filter circuit 10, then the shortest rise time that could be passed without undue degradation would be about 0.1 second.

(2) $f_{min}$ and corresponding delay "T" of FIGS. 2 and 3: If the minimum modulating frequency at which it would be required to generate chorus effect were 0.5 hertz, then the corresponding period of the modulation signals would be 2 seconds. Hence, in order to give the filter 10 of FIG. 3 a reasonable time to recognize the character of the input signal, a delay of about one second will be needed in the delay circuit 11 shown in FIG. 3.

(3) corresponding frequency ratio "R": Since the phase curve 6 of FIG. 2 and the phase curve of FIG. 4 are related to corresponding curves from minimum phase shift network theory, it is desirable to select a frequency ratio from this theory which will correspond to the time interval "T" of FIG. 2, or a one second interval in FIG. 4. This ratio "R" is selected so that the phase will approximate zero when the frequency differs from the frequency at the center of the attenuation ramp (log amplitude 14, in FIG. 2) by the selected ratio. A value of "R" of 0.025 may be selected as approximating this criterion. Since the portion of FIG. 2 from the left vertical axis 15 to the center of the log amplitude ramp 14 is to represent a time of one second, (the delay 11 in FIG. 3), then the phase curve 6 of FIG. 2 must be scaled so that the phase function has this non-significant value at the left vertical axis. In other words, the value of the phase curve one second before the log amplitude ramp must be defined at zero (corresponding to R=0.025).

The one second delay will start at time zero represented by the left vertical axis 15 of FIG. 2, and the output of the filter 10 of FIG. 3 will be zero. At this time the changing amplitude noise signal 7 is applied to the delay 11, and the log amplitude ramp 16 in FIG. 3 (assuming signal 7 is such as to produce a ramp) is applied to the filter 10. One second later, the output 9 of the filter 10 will have attained its maximum value, and the delay 11 will be in the process of delivering its output 8 (the log amplitude ramp) to subsequent circuits. Hence the elements 10, 11 and 12 of FIG. 3 will produce outputs 9 and 8 approximating the dotted curves 13 and 14 respectively of FIG. 2 when a signal 7 as described is applied as shown in FIG. 3. For purposes of illustration, the delay time "T" of delay 11 has been made equal to one second. If the delay time is made too short, the lower frequency components in the filter output 9 will become less accurate approximations of the required phase function of a true chorus signal. Conversely, if the delay is too long, the accuracy required of the delay and filter elements becomes too severe to be assured of a workable system. The chorus effect produced by the arrangement described will then simulate the effect of a multiplicity of sources no two of which are spaced closer than approximately 0.5 hertz or are separated by more than approximately 5 hertz.

Once the three values above are specified it is necessary to identify the phase curve corresponding to the illustrative values chosen. If the corresponding minimum phase shift network having an attenuation characteristic equal to the log amplitude curve 14 of FIG. 2 is considered, the frequency ratio between the center of the attenuation ramp and either and may be defined as the value "a". Since it was assumed that the frequency ratio of R=0.025 corresponded to the assumed one second delay, it may be said that the one second delay corresponds to a value of $\log_{10}(1/0.025)=1.602$ on a logarithmic frequency scale to base 10. Hence, half the assumed rise time (0.05 seconds) will similarly correspond to the $\log_{10}a$. Thus the relation may be written:

$$1.602/1=\log_{10}(a)/0.05 \quad (1)$$

so that $$a=1.20 \quad (2)$$

The phase curve corresponding to this value of "a" may be found in the Bode reference cited on page 352. This phase curve corresponding to the 0.1 second ramp (and having the abscissa replaced with a suitable time scale, as described) is shown in FIG. 4 with the phase values expressed in arbitrary units for convenience. In general, "a" may be defined as follows:

$$a=10 \text{ to the exponent } [f_{min}\log_{10}(1/R)/2f_{max}] \quad (3)$$

It may be noted that a filter 10 which will yield an output voltage wave having the shape of FIG. 4 when subjected to a ramp input having a rise time of 0.1 seconds or less, will also produce an output wave of correct, although modified, shape when ramps having longer rise times are applied to the input. However, with rise times of greater than one second, it is obvious that the rise will overlap the peak of the phase curve and some error will be produced. In the illustrative example, this effect limits the lowest frequency input 7 in FIG. 3 to about 0.5 hertz.

To continue the illustrative example, one possible technique to obtain a filter to approximate the curve of FIG. 4 in response to the ramp input is to approximate the desired time function of FIG. 4 with an analytic expression having an easily obtainable Laplace transform. An expression meeting these requirements between zero and two seconds is as follows:

$$y = 0.2 + 8.07e^{-170(1-t)^2} + 5.73\sin^4\left(\frac{\pi t}{2}\right), 0 < t < 2, \quad (4)$$

where "y" is the phase shift expressed in arbitrary units, and "t" is in seconds. It may be noted that the exponential term provides a very close approximation to the upper half of the curve, and the sine term provides an adequate approximation to the skirts of the curve. Since the constant (0.2) in equation (4) is less than 1.5% of the peak of the phase curve, it may be neglected with little error. This is equivalent to defining the phase curve to be zero at R=0.025 as previously described.

The transfer function of the required filter may be easily derived from the above equation (4) by first taking the Laplace Transform and then multiplying by the transform operator, usually designated as "s", assuming the response of the filter to a step input to be quite similar to the response to the assumed 0.1 second ramp. Letting $s=j\omega$(where $\omega=2\pi x$ frequency) in this transform expression yields the desired transfer function of the filter, designated $F(j\omega)$:

$$F(j\omega) = sL(y) = 1.097j\omega e^{-.00147\omega^2}(e^{-j\omega}) + +.7163\left[3+\frac{4\omega^2}{\pi^2-\omega^2}-\frac{\omega^2}{4\pi^2-\omega^2}\right](1-e^{-2j\omega}). \quad (5)$$

It may be observed from equation (5) that there appear to be poles at $\omega=\pi$ and at $\omega=2\pi$; however, the $1-e^{-2j\omega}$ term has zeros at these same values of $\omega$ so that the magnitude of $F(j\omega)$ is finite at $\omega=\pi$ and $2\pi$. A plot of the required magnitude 17 and phase 18 of filter 10 to satisfactorily generate $F(j\omega)$ is shown in FIG. 5. Equation (5) does not have the same phase variation as that required for a minimum phase shift network. A discussion of minimum and non-minimum phase shift circuits can be found in the Bode reference Section 11.7, pp 242–244. However, it is found that when a minimum phase network is used to produce the magnitude changes shown in FIG. 5, the accompanying phase delay is considerably less than that required by the delay exponentials. Hence the required filter may be synthesized by a suitable minimum phase network plus a non-minimum phase shift network which will produce the required additional phase shift to give a total phase shift equal to that required by equation (5). The required filter may also be synthesized by means of a single non-minimum phase shift network that will produce both the required magnitude and phase variations. The effect of the illustrative assumptions ($f_{max}=5$ Hz and $f_{min}=0.5$ Hz) are clearly visible in FIG. 5 which shows a rapid reduction of the magnitude 17 above 5 Hz, and an approximate 6 dB per octave cut-off rate below 0.5 Hz. Likewise, the one second delay is reflected in the phase 18 which indicates a delay (phase divided by $\omega$) of approximately 1.0 second above 1 Hz. Note also that the phase 18 is zero at about 0.25 Hz, and approaches 90 degrees leading as the frequency is further reduced. The rapid cut-off of curve 17 above 5 Hz in FIG. 5 may be produced by means of a passive or active filter having similar cut-off characteristics. The drop off below 0.5 Hz may be produced by a pole at 0.5 Hz and a zero at zero Hz in the same filter. Little error will be introduced if the top of the magnitude curve 17 is assumed to be flat. A typical filter approximating the required high frequency cut-off response of curve 17 is presented by K. D. Smith in the IEEE Convention Record, 1964, part 8. The required additional phase shift which is required to modify the output of such a typical filter above about 1 Hz may be produced by a numbr of means familiar to those skilled in the art. One possible method is the Pade approximate as described in an article by R. D. Teasdale in the IRE Convention Record, 1953, part 5, p 89–94. A bibliography of various articles on time delay (phase lag) appears in the IRE Transactions on Automatic Control, May 1959, pp 56–64, where a large number of methods of obtaining the required phase shift are presented. In addition, a number of charge transfer devices are available to generate an analog delay quite accurately. Available types are Bucket Brigade Devices, Charge Coupled Devices, and Single Transfer Devices, such as those made by the Reticon Corp. By adjustment of the clock rate, these devices can generate delays as required, and so produced the required phase characteristic 18, since phase equals delay times frequency times $2\pi$. Articles describing typical applications of these devices appear in the EDN magazine of Jan. 5, 1977, p. 55, and in Electronics, Aug. 7, 1975, p. 117. These means of approximating the desired function are cited only by way of illustration—other means are avilable and are known to those skilled in the art. See, for example, the book by Y. W. Lee, "Statistical Theory of Communication," first Ed., 1960, Chap. 19.

Another function required by FIG. 3 is the pure time delay 11. The methods suggested to obtain the additional phase shift required by the filter 10 are applicable to generate this time delay which has been assumed as one second in the illustrative example presented.

The last function required by FIG. 3 is the function generator 12. Such a function may be generated quite easily by means of the logarithmic relation between the current passing through a semiconductor diode and the voltage across the terminals of the diode. If a current representing the noise signal 7 is forced through a diode in the direction of least diode resistance (the forward direction), then the voltage across the diode will be representative of the signal 16 in FIG. 3. Alternately, the base to emitter junction of a bipolar transistor will exhibit similar logarithmic characteristics. Other methods of generating a function may also be applied, and are known to those known to those skilled in the art.

A block diagram of a method of applying the principles disclosed to an electronic music generator is shown in FIG. 3. In addition to the elements 10, 11 and 12 previously described, FIG. 3 also shows a generator 19 which produces the random low frequency signal 7. There are many methods of generating such random low frequency signals. One common method uses the random voltage or current variations that appear in circuits containing a conducting zener diode. Typical of such circuits is the one in the July 1964 issued of EEE magazine, p. 26. Another common method uses a digital pseudorandom sequence generator, often called a shift register generator. An example of such a circuit is shown in Electronics magazine, May 27, 1976, pp. 107–109. Depending on the length of the shift register and the clock frequency, a suitable signal 7 may be obtained. Other methods of generating a random signal are known to those skilled in the art, and would be equally applicable.

FIG. 3 also shows tone signal generators 28 and 29 which are modulated by both the amplitude modulation signal 8 and the phase modulation signal 9. Such generators are used extensively in electronic organs and are well known to those skilled in the art. Simple amplitude modulation and/or phase modulation of the tone signals is a feature of almost all electronic organs, and these effects are referred to as tremolo or vibrator respectively. Many methods of amplitude modulation are currently in use. Typical examples are devices such as the transconductance modulator and the analog multiplier. The transconductance modulator varies its output amplitude by changing its signal transconductance in accordance with the modulating voltage applied to one of its inputs. Examples of this type of device are shown in Electronic Design magazine, Mar. 1, 1978, p.70, and in Electronic Products magazine, Mar. 20, 1972, p.72. The analog multiplier acts to produce an output voltage which is the product of the amplitudes of the signal voltage and the modulating voltage, so that the modulating voltage will produce a modulated signal voltage at the output. Examples of this device are shown in Electronics magazine, June 8, 1870, p.102, and in Analog Devices Co. house organ "Analog Dialogue" 11-1, 1977. Transistor circuits may also function as amplitude modulators; for example, see Electronics magazine, June 12, 1967, p.104.

Various methods are available to phase modulate the tone signal generators. A simple method of phase modulation of a tone signal generator is to use a variable reactance circuit in conjunction with a circuit tuned to the desired tone frequency. Such an arrangement will basically produce frequency modulation; however, if the modulating signal applied to the variable reactance circuit is made proportional to the time rate of change of the phase modulation signal 9 of FIG. 3, the desired phase modulation will be produced. Such modulators are described in books by F. E. Terman, "Radio Engineers Handbook", 1st Ed., 1943, p.654–6, and by A. Hund, "Frequency Modulation", 1st Ed., 1942, pp.155–182. Voltage controlled oscillators will also yield similar results. See, for example, Electronic Design magnazine, Mar. 1, 1975, p.66, and National Semiconductor Corp. Linear Databook, 1978, p.9–40. Other methods of phase modulating the various types of tone signal generators are possible, and are well known to those skilled in the art.

The tone signal outputs from generators 28 and 29 are fed via conductors 30 to the typical electronic organ circuits 32 for keying, summing, filtering, vibrato, tremolo, amplification etc., and having output 33 energizing one or more loudspeakers 34. Circuits 32 are used extensively in electronic organs, and are well known to those skilled in the art.

Alternately, both the amplitude and the phase modulation in FIG. 3 may be applied to one or more composite tone signals derived by summation from the multiplicity of tone signal generators 28 and 29. Such signals are available within the circuitry 32, and the modulating signals 8 and 9 are applied via the alternate circuits 31. The amplitude modulation of the one or more composite tone signals may be done by any of the methods described for producing amplitude modulation of the individual tone signal generators 28 and 29.

The methods described above for phase modulating the tone signal generators are not useful for phase modulating the one or more composite tone signals available within the circuitry 32. Phase modulators capable of such modulation are described by Hund (as cited) on pages 182–190. In particular, the Armstrong modulator of FIG. 51 on page 185 is quite suitable. In this figure the output of the "Fixed F-source" may be identified with the composite tone signal to be modulated, the output of the "f-source" with the phase modulating signal 9 of FIG. 3; the output of the "Balanced amplitude modulator" is proportional to the product of these two signals; the "90-degree phase shifter" shifts the phase of all frequency components in the said product signal by 90 degress, and the output of the "Amplifier" will be the desired phase modulated composite tone signal. The balanced amplitude modulator itself is described by Hund on pages 150–152. The 90 degree phase shifter required for this application must be of a wide-band type, since it must be effective over a reasonable portion of the entire audio frequency spectrum. Techuques for producing such a wide-band 90 degree phase shift have been published; see, for example, an article in Electronics magazine, Aug. 21, 1975, p.82.

This article shows two channels fed by a common input; however, the application of this technique to the block diagram in Hund page 185 requires a circuit similar to FIG. 6, in which the two channels of the 90 degree circuit do not have a common input. In FIG. 6, the composite tone signal 35 (produced in the circuitry 32 in FIG. 3) is applied to all-pass phase shift network 37 and balanced amplitude modulator 43. The phase modulating signal 9 is applied to the other input of balanced amplitude modulator 43, and the output 36 of modulator 43 (the intermediate signal) is applied to all-pass phase shift network 38. Since at any frequency within the desired bandwidth the outputs 39 and 40 of networks 37 and 38 are shifted with respect to their inputs 35 and 36 by amounts which differ by 90 degrees, the output 42 of summing amplifier 41 will be the desired phase modulated composite tone signal. This signal, after typical processing by the circuitry 32 of FIG. 3, (as described) is fed as signal 33 to loudspeaker 34.

ALTERNATE FORM OF THE INVENTION

An alternate form of the invention is also described by FIG. 3. In this embodiment the filter 10 has attenuation and phase characteristics differing from those of the preferred embodiment, and the function generator 12 is an antilog generator. The modulation signal 8 from the delay element 11 will produce phase modulation of the tone signal generators 28 and 29 or their combined signals in block 32, and the modulation signal 9 from filter 10 will produce amplitude modulation of the same generators or signals. However, the filter 10 in this embodiment is derived from equations of greater complexity than is the filter in the preferred embodiment. Nevertheless, this alternate form of the invention will yield results comparable with the preferred embodiment, and is within the scope of this invention.

SPECIAL FORM OF THE INVENTION

A restricted form of chorus effect is produced when only two tone generators of slightly different frequency are sounded together in order to produce a single composite tone. In organ terminology such an effect is called "celeste". In this case the amplitude 1 and phase 2 curves of FIG. 1 would be approximately sinusoidal, with the phase curve leading the amplitude curve by 90 degrees. Equation (5) also reveals this same phase shift. Hence, a modulation scheme in which the phase modulation differs by 90 degrees from the amplitude modulation may be used to produce a celeste signal. To produce such an effect the following parameters are selected in FIG. 3: (a) select a delay "T" of the delay unit 11 approximating zero; (b) select a linear function with function generator 12; (c) select a filter 10 having an approximately constant 90 degree phase shift, and (d) select a low frequency generator 19 having a repetitive waveform of sub-audio or low audio frequency. The signals 8 and 9 are used to frequency and amplitude modulate the tone signal generators 28 and 29, or their combined signals in block 32. Since it is only necessary that the two modulations differ by 90 degrees, either signal 8 or signal 9 may be used to produce the amplitude modulation, and the other used to produce the phase modulation. A filter which will produce a constant 90 degree phase shift is well known to those skilled in the art.

What is claimed is:

1. In an electronic musical instrument, apparatus for generating a chorus tone, comprising;

means to generate a low frequency signal, delay means responsive to the said low frequency signal and operable to produce a first modulating signal by imparting a frequency-independent time delay to said low frequency signal, a tandem means also responsive to said low frequency signal comprising a function generator feeding a non-minimum phase shift bandpass filter to produce a second modulating signal, a tone signal generator, means responsive to said first and second respectively modulating signals to modulate the amplitude and phase of the tone signal produced by said tone signal generator, and means operable to render the amplitude and phase modulated tonesignal audible.

2. Apparatus as set forth in claim 1 in which the said means to generate a low frequency signal produces a random waveform, and the said function generator produces an output signal which is a logarithmic function of said low frequency signal, and the said first modulating signal produced by the said delay means is used to amplitude modulate the said tone signal generator, and the said second modulating signal produced by the said tandem means is used to phase modulate the said tone signal generator.

3. Apparatus as set forth in claim 1 in which the said means is generate a low frequency signal produces a random waveform, and the said function generator produces an output signal which is an exponential function of said low frequency signal, and the said first modulating signal produced by the said delay means is used to phase modulate the said tone signal generator, and the said second modulating signal produced by the said tandem means is used to amplitude modulate the said tone signal generator.

4. In an electronic musical instrument, apparatus for generating a chorus tone, comprising;

means to generate a low frequency signal, delay means responsive to the said low frequency signal and operable to produce a first modulating signal by imparting a frequency independent time delay to said low frequency, a tandem means also responsive to said low frequency signal comprising a function generator feeding a non-minimum phase shift bandpass filter to produce a second modulating signal, a multiplicity of tone signal generators having electrical output signals, apparatus for summing the said electrical output signals of said tone signal generators to produce a composite tone signal, means to modulate the said composite tone signal with the said first modulating signal produced by the said delay means and with the said second modulating signal produced by the said tandem means to produce a modulated tone signal, and apparatus to render the said modulated tone signal audible.

5. Apparatus as set forth in claim 4 in which the said means to generate a low frequency signal produces a random waveform, and the said function generator produces an output signal which is a logarithmic function of said low frequency signal, and the said first modulating signal produced by the said delay means is used to amplitude the said composite tone signal, and the said second modulating signal produced by the said tandem means is used to phase modulate the said composite tone signal.

6. Apparatus as set forth in claim 4 in which the said means to generate a low frequency signal produces a random waveform, and the said function generator produces an output signal which is an exponential function of said low frequency signal, and the said first modulating signal produced by the said delay means is used to phase modulate the said composite tone signal, and the said second modulating signal produced by the said tandem means is used to amplitude modulate the said composite tone signal.

7. Apparatus as set forth in claim 4 in which the said means to modulate the said composite tone signal includes phase modulation means consisting of;

a balanced amplitude modulator effective to modulate the said composite tone signal with the said second modulating signal produced by the said tandem means to produce an intermediate signal, a first means having a first output signal and effective to produce a controlled phase shift of the said intermediate signal, a second means having a second output signal and effective to produce a modified phase shift of the said composite tone signal, said modified phase shift differing by approximately 90 degrees from the said controlled phase shift produced by the said first means, a summer to sum the said first and second output signals to produce a phase modulated composite tone signal, and means to amplitude modulate the said phase modulated composite tone signal with the said first modulating signal produced by the said delay means to produce the said modulated tone signal.

8. Apparatus as set forth in claim 4 in which the said means to modulate the said composite tone signal includes;

means to amplitude modulate the said composite tone signal with the output of the said delay means to produce an amplitude modulated composite tone signal, means to phase modulate the said amplitude modulated composite tone signal including;

a balanced amplitudea modulator effective to modulate the said amplitude modulated composite tone signal with the said second modulating signal produced by the said tandem means to produce an intermediate signal, a first means having a first output signal and effective to produce a controlled phase shift of the said intermediate signal.

a second means having a second output signal and effective to produce a modified phase shift of the said amplitude modulated composite tone signal, said modified phase shift differing by approximately 90 degrees from the said controlled phase shift produced by the said first means, a summer to sum the said first and second output signals to produce the said modulated tone signal.

9. A method of using a low frequency signal to generate a chorus tone signal from a musical tone signal of an electronic musical instrument comprising the steps of;

producing a first modulating signal imparting a frequency-independent time delay to said low frequency signal and, bandpass filtering the waveform of said low frequency signal to produce a second modulating signal, modulating the amplitude of said musical tone signal with one of said modulating signals, and modulating the phase of said musical tone signal with the other of said modulating signals to produce the said chorus tone signal.

* * * * *